US008844493B2

(12) United States Patent
Takano

(10) Patent No.: US 8,844,493 B2
(45) Date of Patent: Sep. 30, 2014

(54) LUBRICATING OIL FEEDING STRUCTURE OF ENGINE

(75) Inventor: Kiyohito Takano, Akashi (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 322 days.

(21) Appl. No.: 12/979,682

(22) Filed: Dec. 28, 2010

(65) Prior Publication Data

US 2012/0160208 A1 Jun. 28, 2012

(51) Int. Cl.

| | |
|---|---|
| ***F01M 11/03*** | (2006.01) |
| ***F01M 5/00*** | (2006.01) |
| ***F01M 11/02*** | (2006.01) |
| ***F01M 1/10*** | (2006.01) |

(52) U.S. Cl.

CPC ..... *F01M 11/02* (2013.01); *F01M 5/002* (2013.01); *F01M 1/10* (2013.01)

USPC ..... 123/196 A; 123/196 AB

(58) Field of Classification Search

CPC ..... F01M 11/02; F01M 11/03

USPC ..... 123/196 A, 41.33, 196 AB, 196 R

See application file for complete search history.

(56) References Cited

U.S. PATENT DOCUMENTS

| | | | | |
|---|---|---|---|---|
| 5,477,817 | A * | 12/1995 | Hufendiek et al. | 123/41.33 |
| 6,631,780 | B1 * | 10/2003 | Hori et al. | 180/292 |
| 2005/0173177 | A1 * | 8/2005 | Smith et al. | 180/233 |
| 2006/0065230 | A1 * | 3/2006 | Hoi | 123/196 AB |
| 2013/0041566 | A1 * | 2/2013 | Gagnon | 701/70 |

FOREIGN PATENT DOCUMENTS

| | | |
|---|---|---|
| JP | 7-11955 | 1/1995 |
| JP | 2007-77925 | 3/2007 |

* cited by examiner

*Primary Examiner* — Lindsay Low
*Assistant Examiner* — Jacob Amick
(74) *Attorney, Agent, or Firm* — Wenderoth, Lind & Ponack, LLP

(57) ABSTRACT

A lubricating oil feeding structure of an engine includes an oil pump provided in a crankcase for pressurizing and feeding oil in an oil reservoir, an oil filter provided in an outer peripheral wall of the crankcase for purifying the oil fed from the oil pump, and an oil cooler provided in a cover member covering an end of the crankcase in the crankshaft direction for cooling the oil sent from the oil filter. Preferably, the cover member is a generator cover, and the oil cooler is arranged on the outer side in the radial direction of a rotor of the generator.

3 Claims, 10 Drawing Sheets

LUBRICATING OIL FEEDING STRUCTURE OF ENGINE

BACKGROUND OF THE INVENTION

1. Field of the Invention

The present invention relates to a lubricating oil feeding structure of an engine, particularly to a lubricating oil feeding structure suitable for an engine of a vehicle.

2. Description of the Related Art

A lubricating oil feeding structure of an engine is generally provided with an oil pump for suctioning lubricating oil (hereinafter simply referred to as the "oil") in an oil reservoir and feeding, an oil filter for purifying the oil fed from the oil pump, and an oil cooler for cooling the purified the oil.

FIG. 9 is a multi-cylinder engine described in Unexamined Japanese Patent Publication No. 2007-77925. An oil cooler 300 is detachably attached to a front end surface of a crankcase 301, an oil filter 302 is detachably attached to a front end surface of an oil pan 303, and an oil pump (not shown) is provided in a lower portion in the crankcase 301. A water pump 305 for cooling the engine is attached to a lower end of the crankcase 301. A plurality of exhaust pipes 311 is connected to a front surface of a cylinder head 310. These exhaust pipes 311 extend downward in the vicinity of a front end surface of the engine, pass through the lower side of the engine, and extend rearward.

FIG. 10 is an engine described in Unexamined Japanese Patent Publication No. 7-11955. An oil cooler 402 and an oil filter 403 are attached to a front end surface of a crankcase 401 while they are arranged side by side in the front and rear direction.

In the engine of FIG. 9, the oil cooler 300 is attached to the front end surface of the crankcase 301 where the exhaust pipes 311 are arranged. Thus, the oil cooler is easily influenced by exhaust heat of the exhaust pipes 311. Thereby, the oil cooler 300 is heated, so that an oil cooling performance is lowered. It should be noted that when the exhaust pipes 311 are arranged so as to be away from the oil cooler 300, the layout of the exhaust pipes 311 is complicated. Further, since the oil cooler 300 is attached and detached from the front side, the exhaust pipes 311 are disturbed at the time of attachment and detachment. Thus, attachment and detachment tasks of the oil cooler 300 are not easily performed.

In the engine of FIG. 10, a forward projecting amount of the oil filter 403 from the crankcase 401 is increased, so that size of the engine in the front and rear direction is increased. Particularly, in a utility vehicle, a distance between a rotating member, such as a propeller shaft or the like, and the oil filter 403 becomes short. Similarly to FIG. 9, the propeller shaft and the oil filter 403 are placed at closer positions. Thus, the attachment and detachment tasks at the time of replacing the oil filter 403 are not easily performed.

SUMMARY OF THE INVENTION

The present invention is achieved in consideration with the above problem, and an object thereof is to provide a lubricating oil feeding structure of an engine capable of maintaining an oil cooling performance by avoiding a thermal influence from exhaust pipes, and easily attaching and detaching an oil cooler. Another object of the present invention is to simplify a structure of a cooling water passage.

In order to achieve the above object, the present invention is to provide a lubricating oil feeding structure of an engine, including; an oil pump provided in a crankcase, the oil pump pressurizing oil in an oil reservoir and feeding; an oil filter provided in an outer peripheral wall of the crankcase, the oil filter purifying the oil fed from the oil pump; and an oil cooler provided in a cover member covering an end of the crankcase in the crankshaft direction, the oil cooler cooling the oil sent from the oil filter.

With the above configuration, the oil cooling performance can be maintained by avoiding the thermal influence from the exhaust pipes to the oil cooler, and attachment and detachment tasks of the oil cooler can be easily performed from the side of the engine together with the cover member. At the time of designing the engine, a freedom degree of arrangement of the oil cooler is increased.

Preferably, the present invention can be further provided with the following configurations.

(a) The cover member is a generator cover covering a generator, and the oil filter is arranged on the outer side in the radial direction of a rotor of the generator when seen in the crankshaft direction.

With the above configuration, the oil cooler is arranged in a space on the outer side in the radial direction of the rotor, so that width in the right and left direction of the engine can be decreased.

(b) An oil passage leading from the oil filter through the oil cooler to a main gallery of the crankcase is constituted only by an oil passage portion formed in the crankcase, and an oil passage portion formed in the cover member.

With the above configuration, an external pipe is no more required as the oil passage, so that the number of parts can be reduced and an assembling task can be easily performed.

(c) The engine is a V-shaped engine having a front cylinder tilting forward and a rear cylinder tilting rearward, the oil filter is arranged in a front surface of the crankcase, and the oil cooler is arranged in a side surface of a front end of the cover member.

With the above configuration, the oil filter and the oil cooler can be arranged by effectively utilizing a blank space of a front part in the V-engine.

(d) The engine is a V-shaped engine having a front cylinder tilting forward and a rear cylinder tilting rearward, and the oil cooler is arranged in the vicinity of a bottom portion of a cylinder body of the front cylinder when seen in the crankshaft direction. Further preferably, the oil cooler is arranged at a position so as to overlap with a starter motor when seen in the crankshaft direction.

With the above configuration, the oil cooler can be arranged by effectively utilizing a blank space of a front lower part of the front cylinder in the V-engine. Alternatively, the oil cooler and the starter motor can be arranged by effectively utilizing the blank space.

(f) The cover member is provided with a water pump for feeding cooling water to the oil cooler.

With the above configuration, since the cover member is provided with the oil cooler and the cooling water pump, a passage for the cooling water can be shortened.

(g) As described above, in a case where the cover member is provided with the water pump, at least part of a cooling water passage from the water pump to the oil cooler is formed in the cover member. Further preferably, the part of the cooling water passage formed in the cover member leads from a rear lower end of the cover member to an upper end of the cover member.

With the above configuration, an external pipe for the cooling water can be shortened. An attachment task of a cooling water pipe can be easily performed from the upper side.

BRIEF DESCRIPTION OF THE DRAWINGS

The above and other objects, features and advantages of the present invention will be become more apparent from the following description taken in connection with the accompanying drawings, in which.

DETAILED DESCRIPTION OF THE PREFERRED EMBODIMENTS

FIGS. 1 to 8 show an engine having a lubricating oil feeding structure according to the present invention, and a utility vehicle provided with this engine. One embodiment of the present invention will be described based on these figures.

(Structure of Vehicle)

Figure 1:
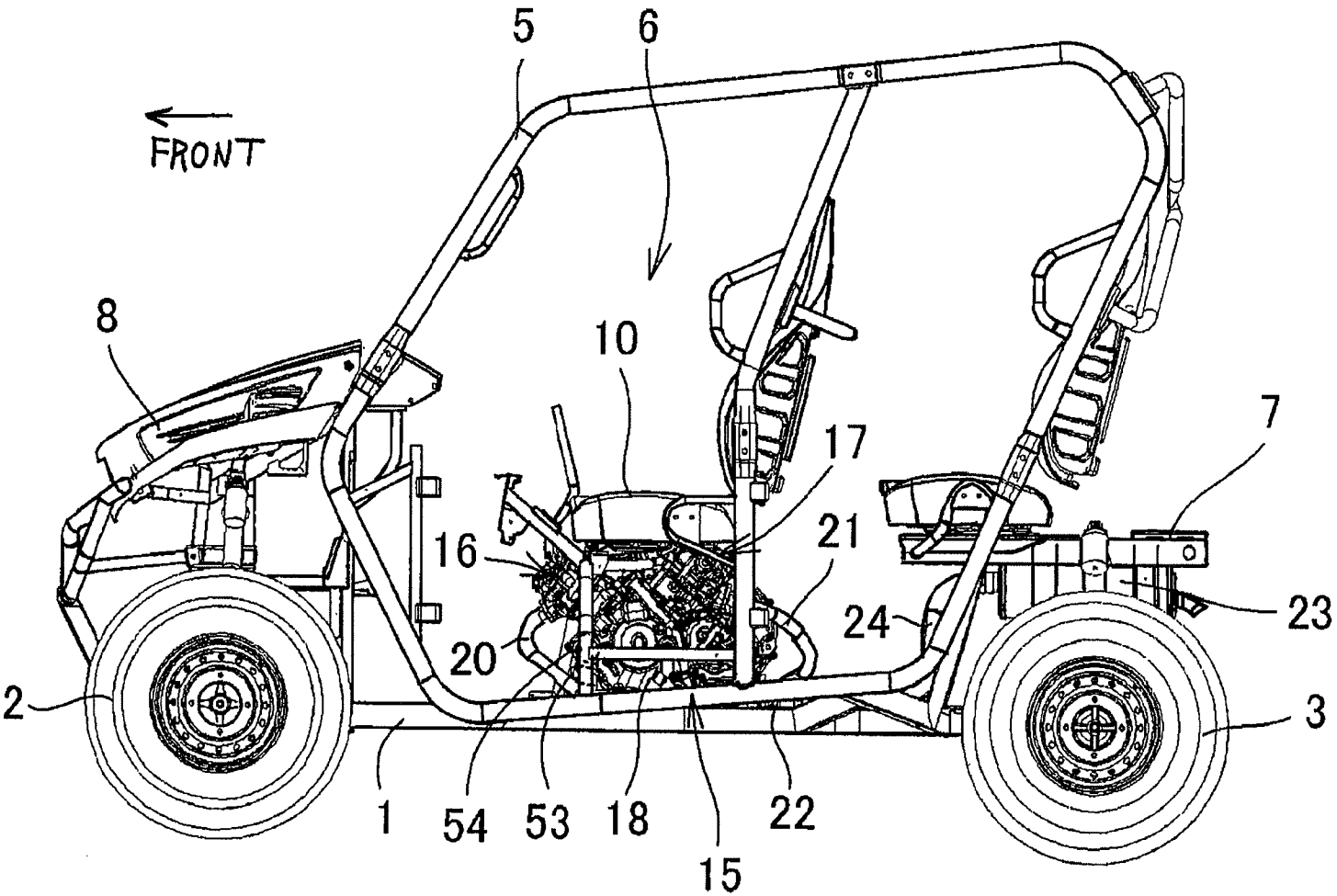
FIG. 1 is a left side view of a utility vehicle provided with an engine having a lubricating oil feeding structure according to the present invention.

In FIG. 1, the utility vehicle is provided with a pair of right and left front wheels 2 in a front part of a vehicle body frame 1, a pair of right and left rear wheels 3 in a rear part of the vehicle body frame 1, a cabin 6 surrounded by a cabin frame (ROPS) 5 between the front wheels 2 and the rear wheels 3, a loading platform 7 on the rear side of the cabin 6, and a bonnet 8 and the like on the front side of the cabin 6. A pair of right and left front seats 10 is installed in a front half part in the cabin 6, and a pair of right and left rear seats 11 is installed in a rear half part in the cabin 6. The cabin frame 5 is generally called ROPS which is an abbreviation of rollover protective structure.

An engine 15 is a V-type twin-cylinder engine which is arranged between the right and left front seats 10, and provided with a crankcase 18, a front cylinder 16 tilting forward, and a rear cylinder 17 tilting rearward.

A front-cylinder exhaust pipe 20 is connected to an exhaust port (not shown) formed in a front surface of the front cylinder 16, extends toward the left lower side in a curved shape, extends rearward in the vicinity of a left lower end of the engine 15, and is connected to a collecting pipe 22 on the rear lower side of the engine 15. A rear-cylinder exhaust pipe 21 is connected to an exhaust port (not shown) formed in a rear surface of the rear cylinder 17, and connected to the collecting pipe 22. A downstream exhaust pipe 24 extending from the rear side of the collecting pipe 22 is connected to an exhaust muffler 23 arranged under the loading platform 7.

(Entire Structure of Engine)

Figure 2:
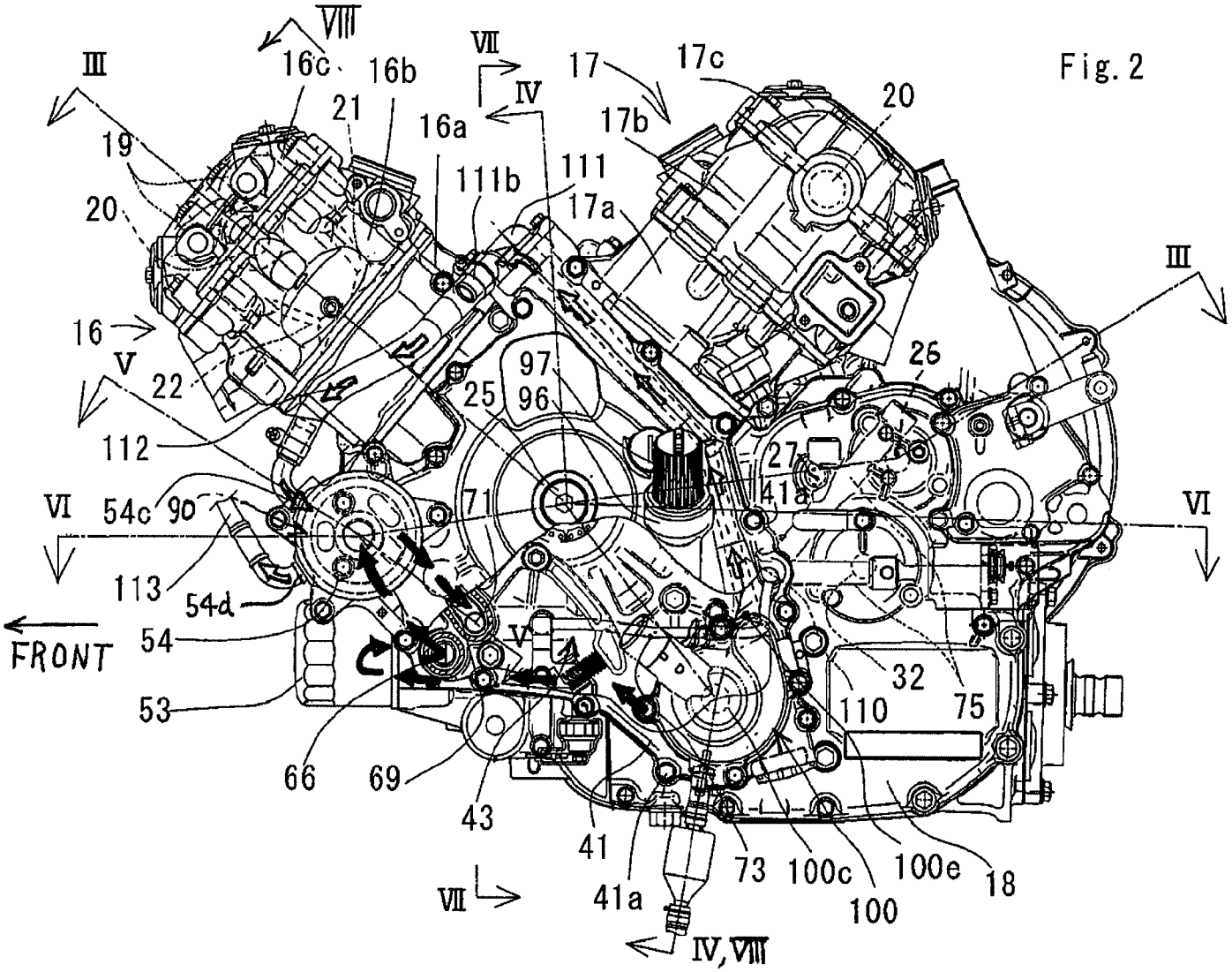
FIG. 2 is a partially sectional left side view showing the engine of FIG. 1.

FIG. 2 is a partially sectional left side view of the V-type twin-cylinder engine, and FIGS. 3 to 7 are sectional views respectively by the lines IV-IV, V-V, VI-VI, and VII-VII of FIG. 2. In FIG. 2, the front cylinder 16 is provided with a front cylinder body 16*a* combined to a front upper end of the crankcase 18, a front cylinder head 16*b* combined to the front cylinder body 16*a*, and a front head cover (rocker arm cover) 16*c* combined to the front cylinder head 16*b*. The rear cylinder 17 is provided with a rear cylinder body 17*a* combined to an upper end of the crankcase 18, a rear cylinder head 17*b* combined to the rear cylinder body 17*a*, and a rear head cover (rocker arm cover) 17*c* combined to the rear cylinder head 17*b*. Rocker arms 19 and a cam shaft 20 for driving intake and exhaust valves 21, 22 are arranged in the front head cover 16*c*. Although not shown, rocker arms and a cam shaft 20 for driving intake and exhaust valves are also arranged in the rear head cover 17*c* similarly to the front head cover 16*c*.

Figure 3:
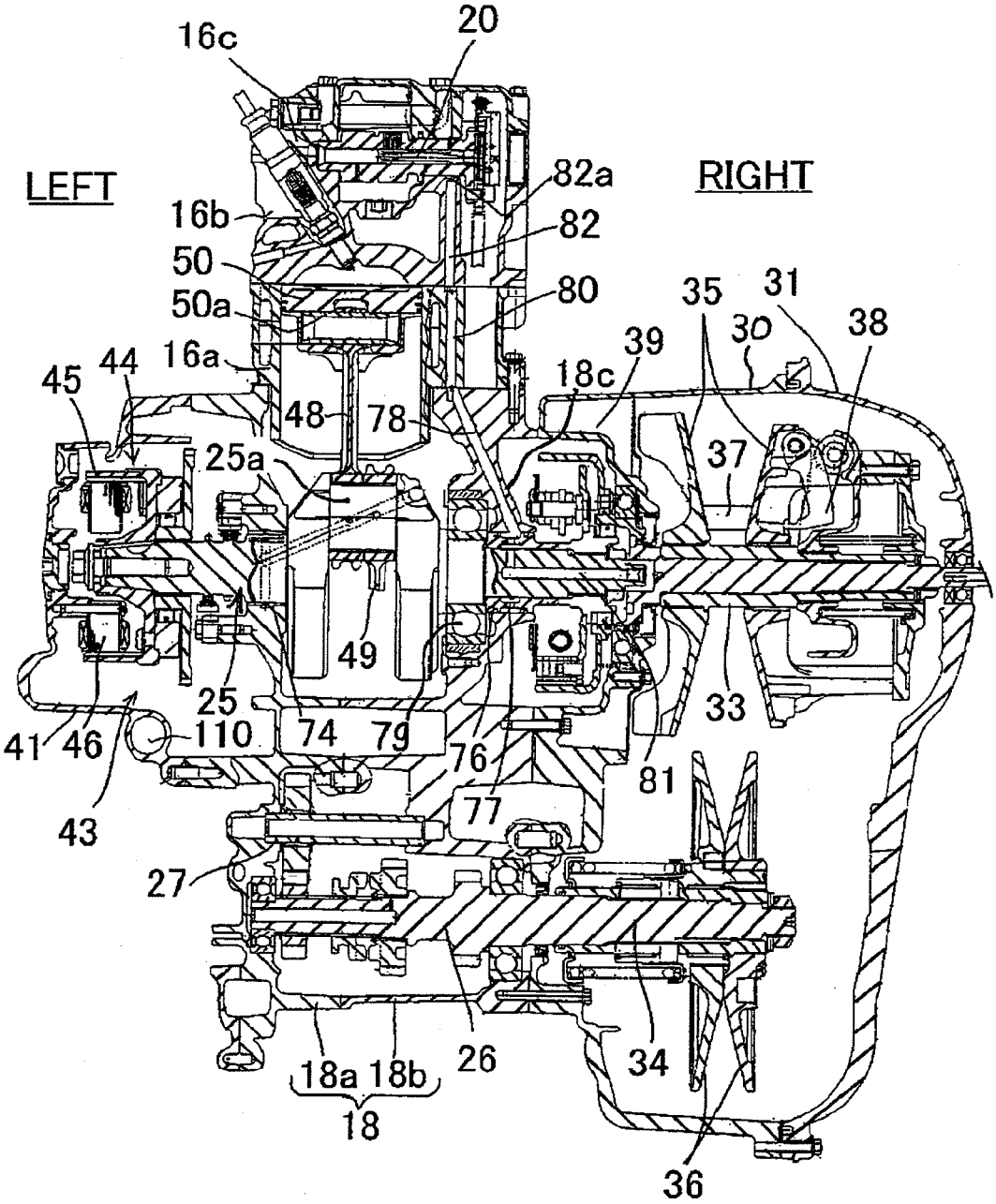
FIG. 3 is a developed sectional view by the line III-III of FIG. 2.

In FIG. 3, the crankcase 18 has a left-right halved structure, and is formed by a left crankcase member 18*a* and a right crankcase member 18*b*. A crankshaft 25 extending in the right and left direction is rotatably supported on a front part of the crankcase 18. An input shaft 26 and an output shaft 32 of a gear type transmission (refer to FIG. 2), an idle shaft 27 for reverse and so forth are arranged in a rear part of the crankcase 18. A big end of a connecting rod 48 for the front cylinder and a big end of a connecting rod 49 for the rear cylinder are fitted to a crank pin 25*a* of the crankshaft 25. A tip end (a small end) of the connecting rod 48 for the front cylinder is fitted to a piston pin 50*a* of a piston 50 for the front cylinder.

A belt case 30 for accommodating a V-belt continuously variable transmission is combined to a right end of the crankcase 18, and a case cover 31 is combined to a right end surface of the belt case 30.

As already known, the V-belt continuously variable transmission is provided with a drive shaft 33, a driven shaft 34, a drive pulley 35 provided in the drive shaft 33, a driven pulley 36 provided in the driven shaft 34, a V belt 37 looped over the drive pulley 35 and the driven pulley 36, a flyweight mechanism 38 provided in the drive pulley 35, and the like. The drive shaft 33 is connected to a right end of the crankshaft 25 via a centrifugal clutch 39, and the driven shaft 34 is integrated with the input shaft 26 of the gear type transmission.

A generator cover 41 is combined to a left end of the crankcase 18 by a plurality of bolts 41*a* (refer to FIG. 2), and the generator cover 41 and a left wall of the crankcase 18 define a generator chamber 43. A generator 44 accommodated in the generator chamber 43 is provided with a rotor 45 secured to a left end of the crankshaft 25, and a stator coil 46 fixed to an inner surface of the generator cover 41.

[Lubricating Oil Feeding Structure]

Figure 4:
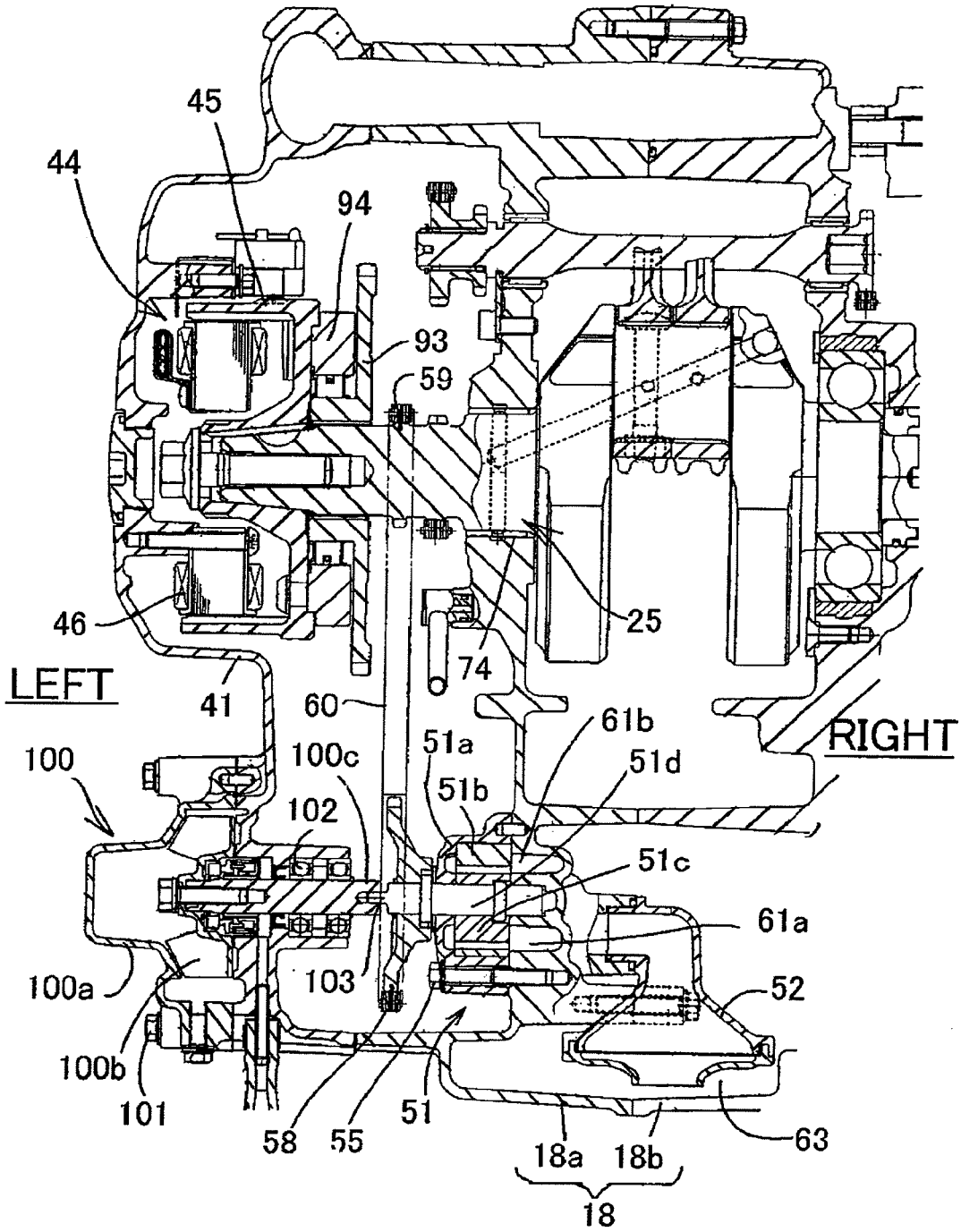
FIG. 4 is a developed sectional view by the line IV-IV of FIG. 2.

The lubricating oil feeding structure has major constituent elements including an oil pump 51 and a strainer (a primary oil filter) 52 shown in FIG. 4, and a secondary oil filter 53 and an oil cooler 54 shown in FIG. 2. The above elements communicate with each other by various oil passages and the like described later.

Figure 5:
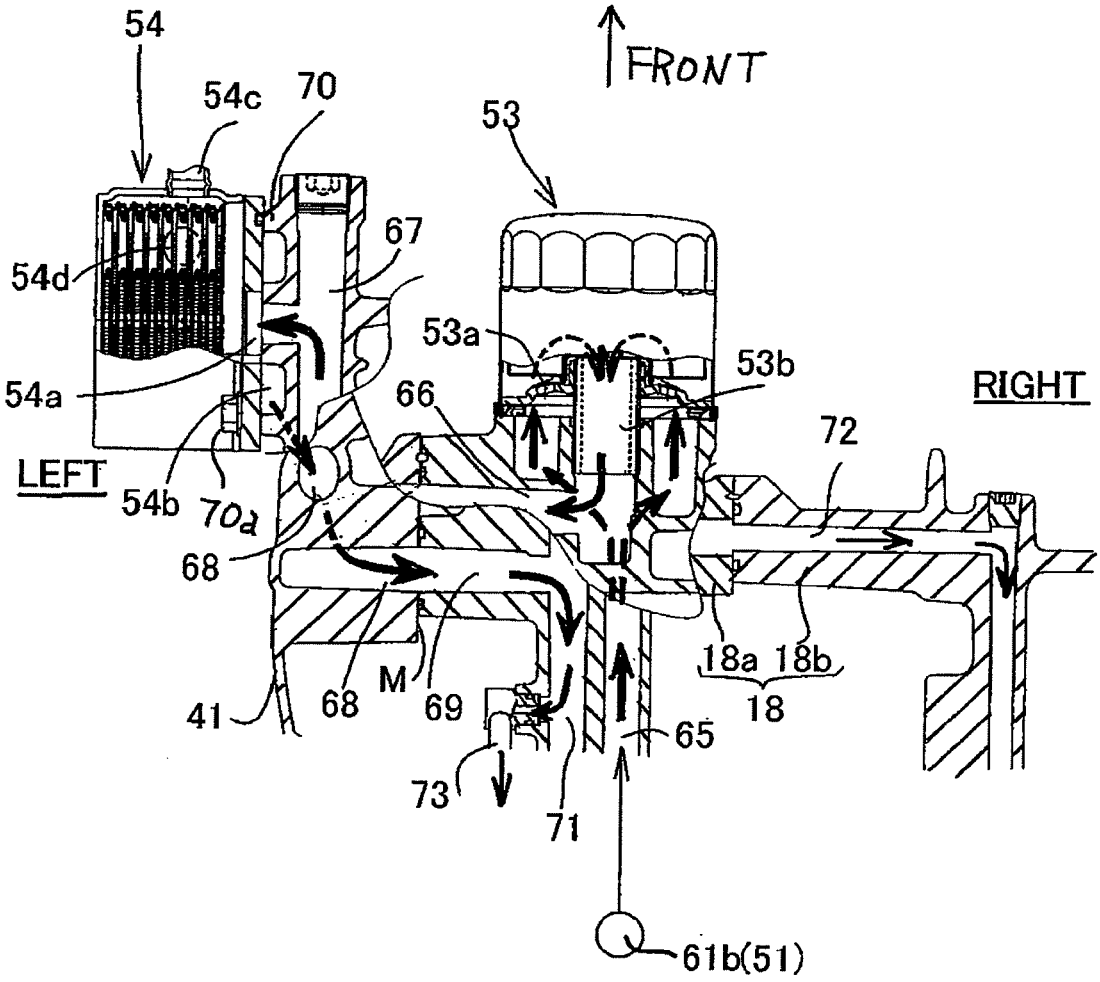
FIG. 5 is a sectional view by the line V-V of FIG. 2.

In FIG. 4, the oil pump 51 is a trochoid pump which is provided with a pump casing 51*a* combined to a left end surface in a lower end of the crankcase 18 by a bolt 55, an outer rotor 51*b* secured to an inner peripheral surface of the pump casing 51*a*, an inner rotor 51*c* rotatably arranged in the outer rotor 51*b*, and an oil pump shaft 51*d* to which the inner rotor 51*c* is secured. A driven sprocket 58 is secured to the oil pump shaft 51*c*1, and the driven sprocket 58 is coupled to a drive sprocket 59 formed in the crankshaft 25 by a chain 60 so as to transmit mechanical power. An oil inlet 61*a* and an oil outlet 61*b* of the oil pump 51 are formed in the crankcase 18, and an upper end of the strainer 52 is connected to the oil inlet 61*a*. A lower end intake port of the strainer 52 opens in an oil reservoir 63 in a lower end of the crankcase 18. As shown in FIG. 5, the oil outlet 61*b* of the oil pump 51 communicates with an oil passage 65 formed in the crankcase 18 (the left crankcase member 18*a*). The oil passage 65 extends forward.

In FIG. 5, the cylindrical secondary oil filter 53 is detachably attached to a front wall surface of the crankcase 18 from the front side and projects forward. The secondary oil filter 53 has a tubular oil outlet 53*b* in a tube core part thereof, and has an oil inlet 53*a* around the oil outlet 53*b*, and a cylindrical filter element (not shown) is provided in an outer case of the cylindrical secondary oil filter 53.

The oil inlet 53*a* of the secondary oil filter 53 communicates with a front end of the oil passage 65 in the crankcase 18, and the oil outlet 53*b* of the secondary oil filter 53 communicates with an L shape oil passage 66 formed in a front end of the crankcase 18. The L shape oil passage 66 in the crankcase 18 turns left and runs to a left end surface of the crankcase 18.

The tubular oil cooler 54 is detachably attached to an oil cooler attaching portion 70 formed in a front end of the generator cover 41 by a plurality of bolts 70*a* from the left side. The tubular oil cooler 54 projects leftward. The oil cooler 54 has an oil inlet 54*a* in a tube core part thereof, has an oil outlet 54*b* around the oil inlet 54*a*, and further has a cooling water inlet 54*c* and a cooling water outlet 54*d* described later in an outer peripheral surface thereof. The oil inlet 54*a* in the tube core part communicates with an L shape oil passage 67 formed in the generator cover 41. The L shape oil passage 67 communicates with the L shape oil passage 66 in the crankcase 18 on a mating surface M between the generator cover 41 and the crankcase 18.

The oil outlet 54*b* of the oil cooler 54 communicates with an oil passage 68 formed in the generator cover 41. The oil passage 68 communicates with a main oil passage (a main gallery) 69 formed in the crankcase 18 on the mating surface M between the generator cover 41 and the crankcase 18.

Figure 7:
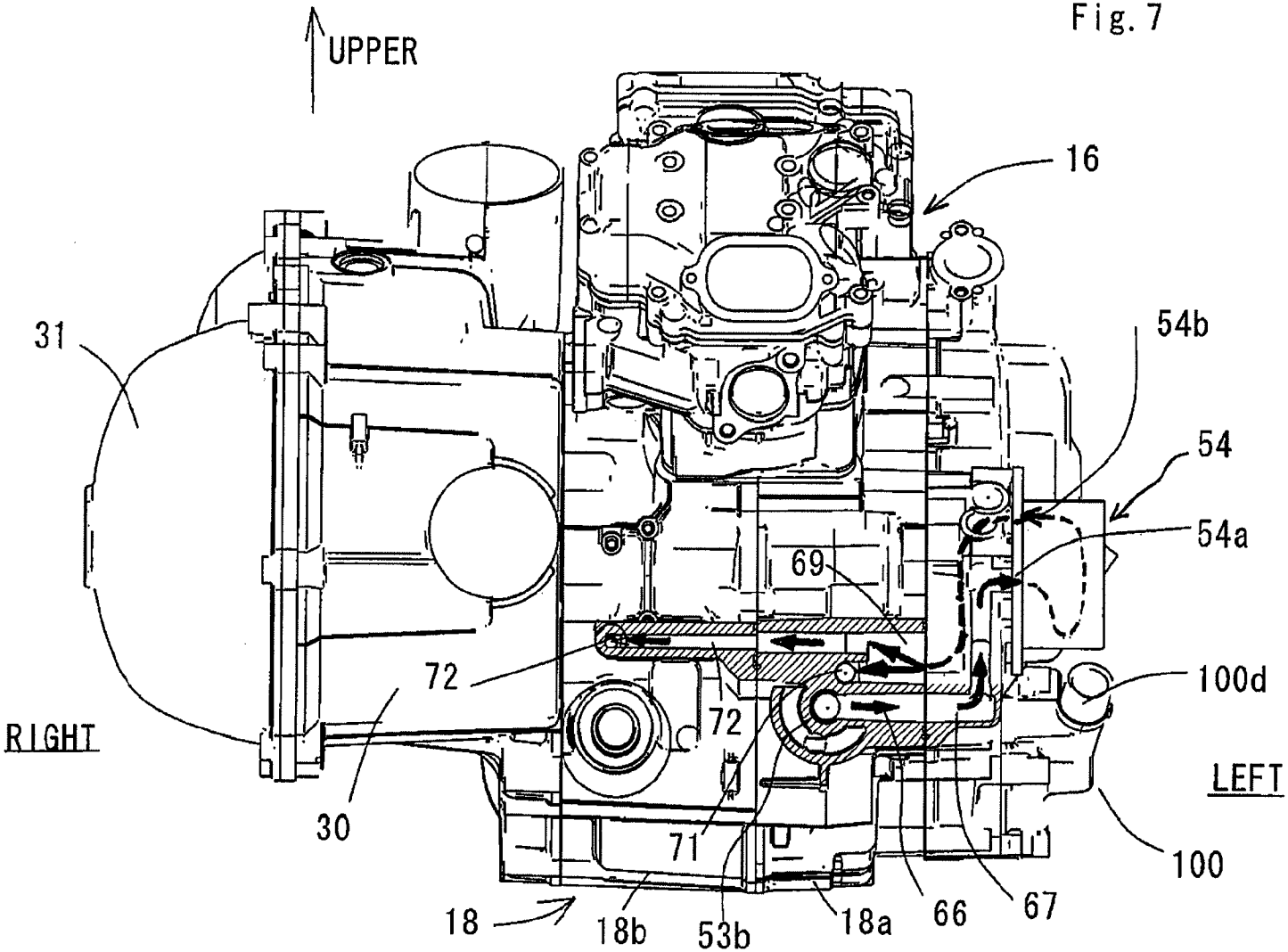
FIG. 7 is a sectional view by the line VII-VII of FIG. 2.

In FIG. 7, the main oil passage 69 formed in the crankcase 18 bifurcates in the middle. That is, the main oil passage 69 bifurcates into a left oil passage 71 formed in the left crankcase member 18*a*, and a right oil passage 72 formed in the right crankcase member 18*b*.

In FIG. 5, an oil feeding pipe 73 is connected to the left oil passage 71. In FIG. 2, the oil feeding pipe 73 extends rearward in the generator chamber 43 and communicates with oil passages 75 formed in the rear part of the crankcase 18. The oil passages 75 communicate with oil filling portions of the shafts 26, 27, 32 and the like of the gear type transmission.

The left oil passage 71 communicates with a left bearing 74 of the crankshaft 25 shown in FIG. 3, and the crank pin 25*a*.

The right oil passage 72 of the crankcase 18 of FIG. 5 communicates with an oil passage 78 formed in the right crankcase member 18*b* in FIG. 3. A projection portion 18*c* projecting rightward is integrated with the right crankcase member 18*b* supporting a right bearing 79 (FIG. 3) of the crankshaft 25. The projection portion 18*c* is fitted to an outer peripheral surface of a seal ring 76 fitted onto the crankshaft 25.

One end of the oil passage 78 in the right crankcase member 18*b* passes through the inside of the projection portion 18*c* and communicates with an oil hole 77 of the seal ring 76. The oil hole 77 communicates with an oil passage 81 in the crankshaft 25, and the oil passage 81 communicates with a sliding part of the centrifugal clutch 39. The other end of the oil passage 78 in the right crankcase member 18*b* communicates with an oil passage 80 formed in the cylinder body 16*a* of the front cylinder 16.

The other end of the oil passage 80 in the front cylinder body 16*a* communicates with an oil passage 82 formed in the front cylinder head 16*b*. A nozzle portion 82*a* is formed in a tip end of the oil passage 82 in the cylinder head 16*b*. The nozzle portion 82*a* opens toward the cam shaft 20 for the front cylinder 16 so as to spray oil toward the cam shaft 20.

Although not shown, with respect to the rear cylinder 17, oil passages extending on the side of the head cover are also formed in the cylinder body 17*a* and the cylinder head 17*b* for the rear cylinder in FIG. 2 similarly to the front cylinder 16 as a matter of course, so that the oil is sprayed toward the cam shaft for the rear cylinder 17.

Figure 6:
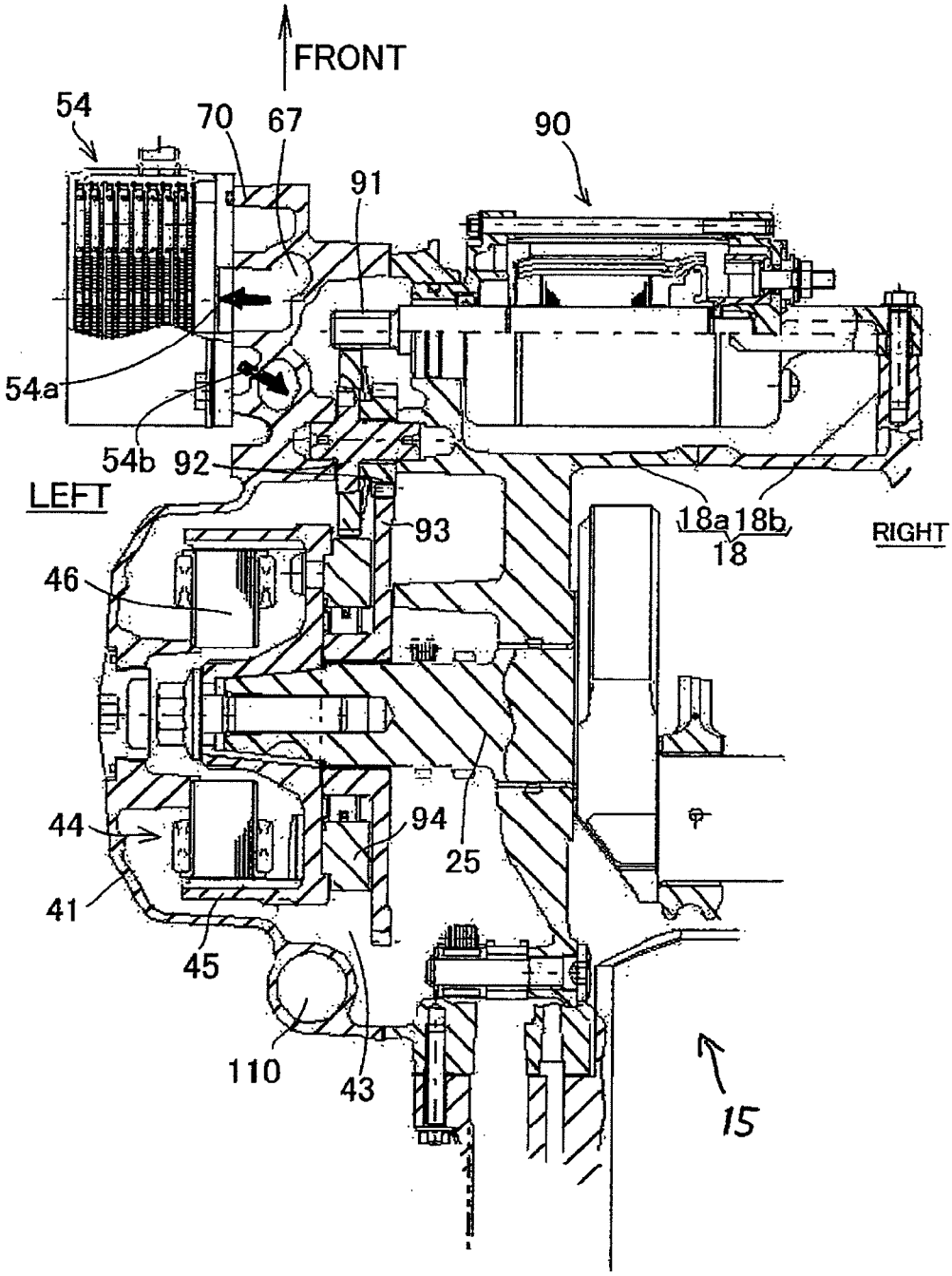
FIG. 6 is a sectional view by the line VI-VI of FIG. 2.

In FIG. 6, the present invention is also characterized by arrangement of the oil cooler 54. The oil cooler 54 is placed at a position so as to substantially overlap with a starter motor 90 when seen from the left side. Moreover, the oil cooler 54 is placed on the outer side in the radial direction of the rotor 45 of the generator 44. The oil cooler attaching portion 70 is formed at a position on the front side of a front end of the rotor 45. More over, the oil cooler attaching portion 70 is positioned at a position largely displaced on the right side (the inner side in the crankshaft direction) of a left end of the generator cover 41. The starter motor 90 is attached to a front surface of the crankcase 18, and an output pinion 91 of the starter motor 90 is coupled to a starter gear 93 via an idle gear 92. The starter gear 93 is rotatably fitted to an outer peripheral surface of the crankshaft 25, and coupled to the rotor 45 of the generator 44 via a one-way clutch 94. The rotor 45 is secured to the crankshaft 25 as described above.

In FIG. 2, when seen from the left side, the starter motor 90 and the oil cooler 54 are arranged in the vicinity of a lower end of the cylinder body 16*a* of the front cylinder 16, that is, at a position on the upper side of the secondary oil filter 53, and arranged on the front side of the generator 44. It should be noted that an oil filler opening 96 is formed in the generator cover 41, and an oil level gauge 97 is inserted into this oil filler opening 96.

[Cooling Water Feeding Structure]

Figure 8:
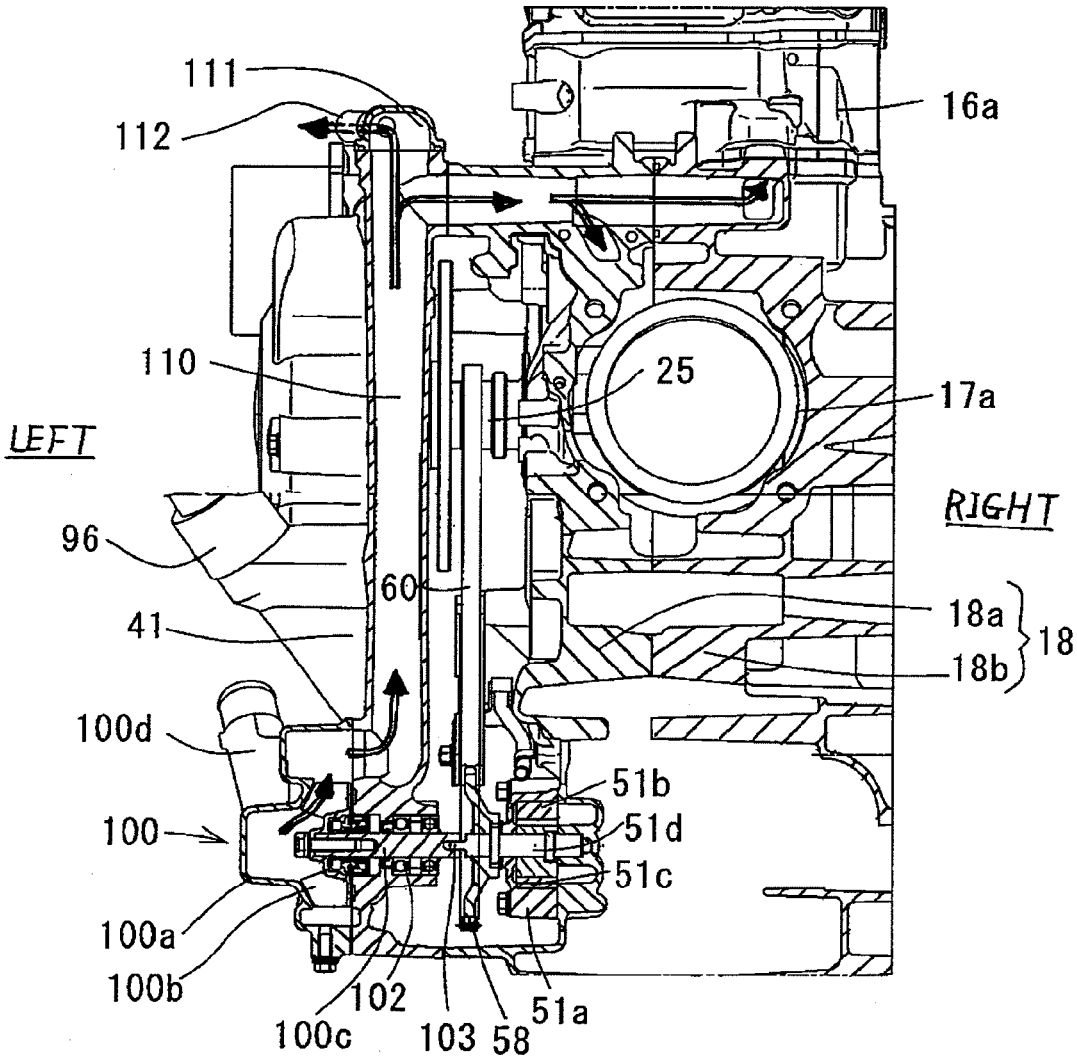
FIG. 8 is a sectional view by the line VIII-VIII of FIG. 2.
Figure 9:
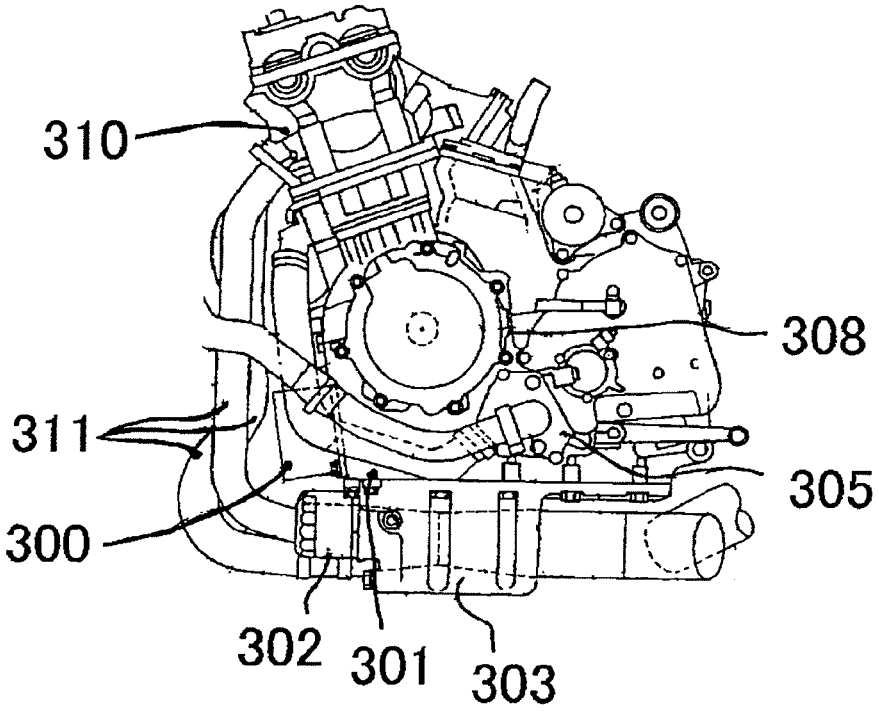
Fig.9 (Prior Art)
FIG. 9 is a side view of a conventional example.
Figure 10:
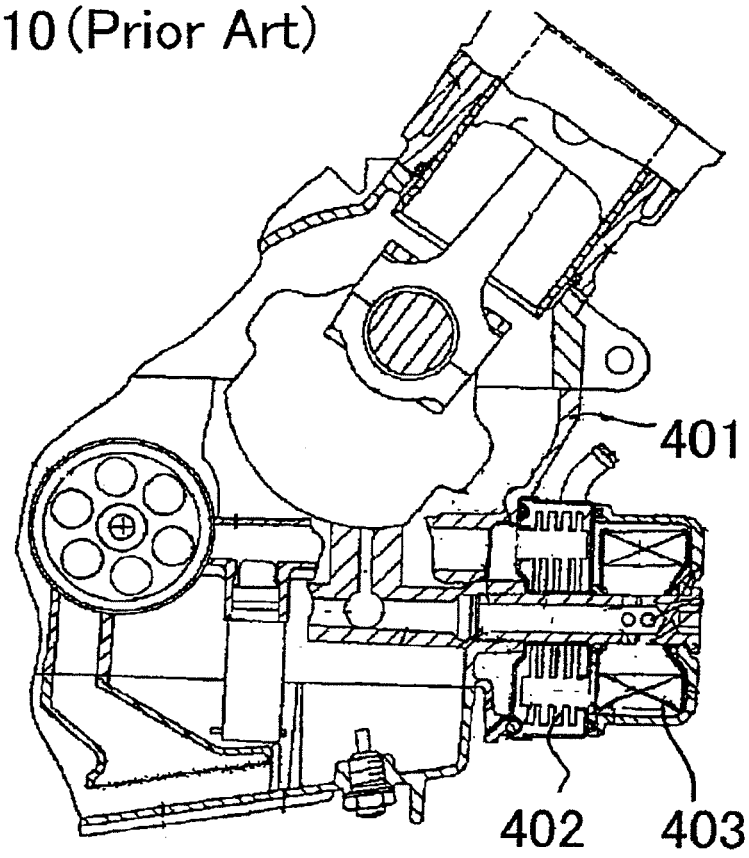
Fig.10 (Prior Art)
FIG. 10 is a vertical side view of another conventional example.

The cooling water feeding structure has major elements including a radiator (not shown), a water pump 100 shown in FIG. 4, and the like. In FIG. 8, the water pump 100 is provided with a pump casing 100*a*, an impeller 100*b* arranged in the pump casing 100*a*, and a pump shaft 100*c* to which the impeller 100*b* is secured. The pump casing 100*a* is detachably attached to a left side surface of a rear lower end of the generator cover 41 by a plurality of bolts 101(FIG. 4).

The pump shaft 100*c* of the water pump 100 is rotatably supported on the generator cover 41 via a bearing 102, and arranged coaxially to the pump shaft 51*d* of the oil pump 51. A right end of the pump shaft 100*c* of the water pump 100 is coupled to a left end of the pump shaft 51*d* of the oil pump 51 via an Oldham's coupling 103, so that the mechanical power is transmitted from the pump shaft 51*d* of the oil pump 51.

A cooling water inlet 100*d* of the water pump 100 projects toward the front upper side in a tubular shape, and the cooling water inlet 100*d* is connected to a cooling water feeding port of the radiator (not shown) via a cooling water hosepipe (not shown).

A cooling water outlet 100*e* of the water pump 100 communicates with a cooling water passage 110 formed in the generator cover 41 (refer to FIGS. 2 and 8). This cooling water passage 110 extends substantially upward along a rear edge of the generator cover 41 and runs to an upper end of the generator cover 41. A fitting 111 is attached to the upper end of the generator cover 41, and an upper end of the cooling water passage 110 of the generator cover 41 communicates with the fitting 111.

In FIG. 2, the fitting 111 has a cooling water outlet 111*b* projecting toward the front lower side, and a cooling water hosepipe 112 is connected to this cooling water outlet 111*b*. The cooling water hosepipe 112 extends toward the front lower side, and is connected to the cooling water inlet 54*c* of the oil cooler 54. A cooling water hosepipe 113 is connected to a cooling water outlet 54*d* of the oil cooler 54. The cooling water hosepipe 113 is connected to cooling water inlets (not shown) formed in the cylinder bodies 16*a*, 17*a* of the cylinders 16, 17, and connected to cooling water passages (not shown) running from the cylinder heads 16*b*, 17*b* in the cylinders 16, 17 through thermostat bodies to the radiator.

[Flows of Lubricating Oil]

In the figures, flows of the lubricating oil are shown by bold solid arrows and broken arrows.

(1) In FIG. 4, the oil of the oil reservoir 63 in the crankcase 18 is suctioned into the oil pump 51 through the strainer (the primary oil filter) 52, pressurized, and then sent from the oil outlet 61*b* through the oil passage 65 in the crankcase 18 in FIG. 5 into the secondary oil filter 53.

(2) In FIG. 5, the oil purified in the secondary oil filter 53 is brought into the oil cooler 54 through the L shape oil passage 66 in the crankcase 18 and the L shape oil passage 67 in the generator cover 41, and cooled by cooling water.

(3) The oil cooled in the oil cooler 54 is sent to the main oil passage (the main gallery) 69 in the crankcase 18 through the oil passage 68 in the generator cover 41.

(4) The oil sent to the main oil passage 69 is divided into the right and left oil passages 71, 72. The oil sent to the left oil passage 71 is fed to lubricating points of the shafts 26, 27, 28 of the gear type transmission through the oil feeding pipe 73 and the oil passages 75 in the crankcase 18 shown in FIG. 2, and also fed to the left bearing 74 and the crank pin 25*a* in FIGS. 3 and 4.

(5) Part of the oil sent to the right oil passage 72 in FIG. 5 is fed to the centrifugal clutch 39 from the oil passage 78 in the crankcase 18 through the oil hole 77 of the seal ring 76 and the oil passage 81 in the crankshaft 25 in FIG. 3. Meanwhile, the other oil passes through the oil passage 80 of the cylinder body 16*a* of the front cylinder 16 and the oil passage 82 in the cylinder head 16*b* and is injected from the nozzle portion 82*a* toward the cam shaft 20. As a matter of course, the cam shaft of the rear cylinder 17 is similarly lubricated.

[Flows of Cooling Water]

Flows of the cooling water are shown by solid white arrows.

(1) The cooling water discharged from the water pump 100 in FIG. 8 passes through the cooling water passage 110 of the generator cover 41 up to the upper end of the generator cover 41, and is brought into the fitting 111.

(2) The cooling water brought into the fitting 111 is sent to the front lower side through the cooling water hosepipe 112 in FIG. 2, and fed into the oil cooler 54 so as to cool the oil in the oil cooler 54.

(3) The cooling water utilized for cooling in the oil cooler 54 passes from the cooling water outlet 54*d* through the cooling water hosepipe 113, and is further discharged to the cooling water passages running from the cylinder heads 16*b*, 17*b* through the thermostats and the like (not shown) to the radiator.

[Effect of the Embodiment]

(1) As shown in FIGS. 5 and 6, the oil cooler 54 is attached to the generator cover 41 covering one side surface of the crankcase 18 in the crankshaft direction. Thus, by attaching the generator cover 41 to the crankcase 18, the oil cooler 54 can be attached, so that an attachment task of the oil cooler 54 can be easily performed.

(2) As in FIG. 1, the oil cooler 54 can be placed away from the front-cylinder exhaust pipe 20. Thus, an influence on the oil cooler 54 by exhaust heat of the exhaust pipe 20 is reduced, so that an oil cooling performance can be maintained.

(3) As in FIG. 6, the oil cooler 54 is arranged on the outer side in the radial direction of the rotor 45 of the generator 44, specifically on the front side. Thus, a leftward projecting amount of the oil cooler 54 can be suppressed. Thereby, width in the right and left direction of the engine 15 can be decreased.

(4) As shown in FIGS. 5 and 7, all the oil passages 66, 67, 68 leading from the secondary oil filter 53 through the oil cooler 54 to the main oil passage 69 in the crankcase 18 are formed in walls of the crankcase 18 and the generator cover 41. Thus, an external pipe (pipe member to be laid) is no more required, so that the number of parts for feeding the oil can be reduced and an assembling task can be easily performed.

(5) In FIG. 2, in the V-type engine having the front cylinder 16 tilting forward and the rear cylinder 17 tilting rearward, the oil cooler 54 and the starter motor 90 are arranged on the front side of a bottom of the front cylinder 16. Thus, a blank space of a front part in the V-type engine can be effectively utilized, so that size of the engine 15 can be decreased.

(6) In FIG. 2, the oil cooler 54 and the water pump 100 are attached to the generator cover 41. Thus, a cooling water route from the water pump 100 to the oil cooler 54 can be shortened.

(7) In FIG. 2, the cooling water passage 110 leading from the cooling water outlet 100*e* of the water pump 100 provided in the rear lower end of the generator cover 41 to the upper end of the generator cover 41 is formed in the generator cover 41. Thus, the cooling water hosepipe 112 from the fitting 111 to the oil cooler 54 can be shortened and also arranged linearly, so that a piping task can be easily performed.

(8) In FIG. 2, the cooling water passage 110 formed in the generator cover 41 leads to the upper end of the generator cover 41 and is connected to the fitting 111 in the upper end. Thus, a connection task of the cooling water hosepipe 112 to the fitting 111 can be easily performed from the upper side.

[Other Embodiments]

(1) In the above embodiment, the oil cooler is arranged on the front side of the rotor of the generator. However, the oil cooler can be arranged for example on the lower side or the upper side of the rotor as long as being arranged on the outer side in the radial direction of the rotor.

(2) The present invention is not limited to the V-type twin-cylinder engine but can be applied to a single-cylinder engine or an in-line multi-cylinder engine.

(3) The present invention is not limited to the utility vehicle as in FIG. 1 but can be applied to an engine provided in a straddle type four-wheeled vehicle or a motorcycle.

(4) The cover member covering the end of the crankcase in the crankshaft direction is not limited to the above generator cover but can be applied to a clutch cover.

(5) The present invention is not limited to the above embodiments but variously modified examples can be adopted within a scope not departing from the claims.

What is claimed is:

1. A lubricating oil feeding structure of a V-type engine of a utility vehicle, the V-type engine having a front cylinder tilting forward, a rear cylinder tilting rearward, and a crankcase housing a gear transmission in a rear portion thereof, the V-type engine being located under a passenger seat, and a v-belt continuous variable transmission (CVT) is provided on the V-type engine so as to transmit a power of a crank shaft to an input shaft of the gear transmission, wherein the crankshaft longitudinal axis extends along and defines a crankshaft direction;

the lubricating oil feeding structure comprising:

an oil reservoir formed in a lower end of the crankcase supporting both ends of the crankshaft;

an oil pump provided in the crankcase, the oil pump pressurizing oil in the oil reservoir and feeding;

an oil filter provided on a front surface of the crankcase so as to project forwardly from the front surface, the oil filter purifying the oil fed from the oil pump, the oil filter having a cylindrical shape;

an oil cooler provided on a side surface of a generator cover covering a generator at an end of the crankcase in the crankshaft direction, the oil cooler being operable to cool the oil sent from the oil filter, the oil cooler having a cylindrical shape;

a water pump provided on the side surface of the generator cover, the water pump feeding cooling water to the oil cooler;

an oil passage leading from the oil pump through the oil filter and the oil cooler to a main gallery of the crankcase; and a cooling water passage from the water pump to the oil cooler, wherein:

the v-belt continuous variable transmission (CVT) is located on an opposite side of the generator cover in the vehicle width direction in relation to the oil cooler;

the oil filter is arranged in front of a rotor of the generator when seen in the crankshaft direction;

the oil cooler is arranged in the vicinity of a bottom portion of a cylinder body of the front cylinder so as to overlap with a starter motor when seen in the crankshaft direction;

the oil cooler is positioned in approximately the same location of the oil filter in the fore-aft direction, and is positioned above the oil filter in a vertical direction;

the oil passage is constituted of only an oil passage portion formed in the crankcase and an oil passage portion formed in the generator cover without using any external pipes, and the oil passage falls inside a range of a width and a longitudinal length of the engine so as not to project outside of the engine; and the cooling water passage is arranged radially outside of the rotor of the generator so as to enclose the generator when seen in the crank shaft direction.

2. The lubricating oil feeding structure of the engine according to claim 1, wherein at least part of a cooling water passage from the water pump to the oil cooler is formed in the generator cover.

3. The lubricating oil feeding structure of the engine according to claim 2, wherein the part of the cooling water passage formed in the generator cover leads from a rear lower end of the generator cover to an upper end of the generator cover.

* * * * *